US005736213A

United States Patent [19]

Meier

[11] Patent Number: 5,736,213

[45] Date of Patent: Apr. 7, 1998

[54] LOTION APPLICATIOR AND MASSAGING DEVICE

[75] Inventor: Shiolett B. Meier, Edmond, Okla.

[73] Assignee: Useful Products, Inc., Edmond, Okla.

[21] Appl. No.: 784,093

[22] Filed: Jan. 15, 1997

[51] Int. Cl.[6] ..... A45D 34/04

[52] U.S. Cl. ..... 428/76; 401/8; 15/222; 601/113; 601/137

[58] Field of Search ..... 428/76, 99; 401/6, 401/8; 15/222; 601/113, 137

[56] References Cited

U.S. PATENT DOCUMENTS

| | | | |
|---|---|---|---|
| 1,488,332 | 4/1924 | Foerg | 15/244.1 |
| 2,730,745 | 1/1956 | Norman | 15/122 |
| 3,674,374 | 7/1972 | Jennings | 401/8 |
| 3,699,980 | 10/1972 | Carpenter | 132/88.7 |
| 3,720,205 | 3/1973 | Liebman | 128/67 |
| 3,812,849 | 5/1974 | Giunta | 128/67 |
| 3,875,933 | 4/1975 | Schwab | 128/67 |
| 4,187,575 | 2/1980 | Collins | 15/222 |
| 4,422,205 | 12/1983 | Braxter, Sr. | 15/222 |
| 4,761,849 | 8/1988 | Taylor | 15/222 |
| 5,013,171 | 5/1991 | Almond, II | 401/6 |
| 5,251,990 | 10/1993 | Vought et al. | 401/8 |
| 5,295,280 | 3/1994 | Hudson et al. | 15/222 |
| 5,545,456 | 8/1996 | Suida | 428/2 |

FOREIGN PATENT DOCUMENTS

| | | | |
|---|---|---|---|
| 504234 | 7/1954 | Canada | 15/222 |
| 1163541 | 4/1958 | France | 15/222 |
| 19125 | 8/1911 | United Kingdom | 15/222 |
| 278906 | 10/1921 | United Kingdom | 15/222 |
| 2165748 | 4/1986 | United Kingdom | 15/222 |

OTHER PUBLICATIONS

Hong Kong Enterprise Jun. 1992, P 360: Item 01 on far left.

*Primary Examiner*—Alexander Thomas
*Attorney, Agent, or Firm*—Robert Treece

[57] ABSTRACT

An elongated body of generally smooth non-absorbent material with elastic handles on opposite ends thereof. The handles are designed and attached in such a manner to enable one with limited use of the hands to easily hold the device when in use. All the exterior surfaces of the device are nonabrasive and generally soft to prevent irritation of tender or damaged skin. Balls or the like may be included inside the body of the device to provide massaging properties.

20 Claims, 3 Drawing Sheets

LOTION APPLICATIOR AND MASSAGING DEVICE

FIELD OF THE INVENTION

The present invention relates to flexible apparatuses for applying lotion to and/or massaging hard to reach locations on a body.

DESCRIPTION OF THE PRIOR ART

Applying lotion to some parts of one's body may be challenging if not impossible without the aid of a device. For example, the back and foot are often difficult to reach with a hand, and in some cases they cannot be reached at all. In the past, devices having a belt or elongated strip have been used to apply or massage such hard to reach areas. However, such prior art devices are difficult to grasp especially if one has limited use of the hands, or is missing all or part of a hand. Some prior art devices require the user to grasp a cylindrical housing in order to use the device. Grasping a cylinder is inconvenient for anyone but virtually impossible if missing a thumb. Other devices show an elongated strip of flexible material having finger holes. It goes without saying that one must have fingers to use the device, but further than that, one must be able to manipulate their fingers into the finger holes. In addition, the forces exerted on the fingers when using the device may cause pain to one with arthritis or an injury. The current device has strips of nonabrasive elastic material which are attached to form open loops. These open loop handles may be used by an amputee, one who is diabetic, elderly, young or arthritic. Even one who has paralysis, immobility or numbness can use the invention described herein.

There are many other disadvantages to the prior devices including: they are difficult to clean; they waste lotion since they can absorb the lotion; they are often one sided; they will fold excessively when in use; they will not stand heat such as when drying in a clothing dryer; and they cannot be easily disinfected with alcohol or the like.

SUMMARY OF THE INVENTION

In view of the foregoing disadvantages inherent in the known types of lotion applicators and massage devices now known, the present invention provides an improved lotion applicator and massage device construction wherein the same can be utilized reliably in those situations where an easy to use, easy to clean, effective lotion applicator and/or massage device is desired. As such, the general purpose of the present invention, which will be described subsequently in greater detail, is to provide a new and improved lotion applicator and massage device which has many advantages over the prior art devices.

To attain this, the present invention essentially comprises a body of generally smooth, non-absorbent material with elastic handles on opposite ends thereof. The handles are designed and attached in such a manner to enable one with limited use of the hands to easily hold the device when in use. All the exterior surfaces of the device are non-abrasive and generally soft to prevent irritation of tender or damaged skin. Balls or the like may be included inside the body of the device to provide massaging properties.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the United States Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved lotion applicator and massage device which may be easily and efficiently manufactured and marketed.

It is a further object of the present invention to provide a new and improved device which is of a durable and reliable construction.

An even further object of the present invention is to provide a new and improved device which may be folded for storage and still provides a generally flat surface for applying lotion.

Still another object of the present invention is to provide a new and improved lotion applicator and massage device which provides in the apparatuses and methods some of the advantages of the prior art, while simultaneously overcoming some of the disadvantages normally associated therewith.

Another object of the present invention is to provide a new and improved lotion applicator or massage device which is easy to use even if one has limited range of motion, is of advanced age, has a disability, or is obese.

Yet another object of the present invention is to provide a new and improved lotion applicator or massage device which is easy to clean to help prevent the growth or spread of microorganisms.

These, together with other objects of the invention, and along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a top plan view of yet another embodiment of a lotion applicator constructed in accordance with the present invention.

DETAILED DESCRIPTION OF THE PREFERRED EMBODIMENTS

Figure 1:
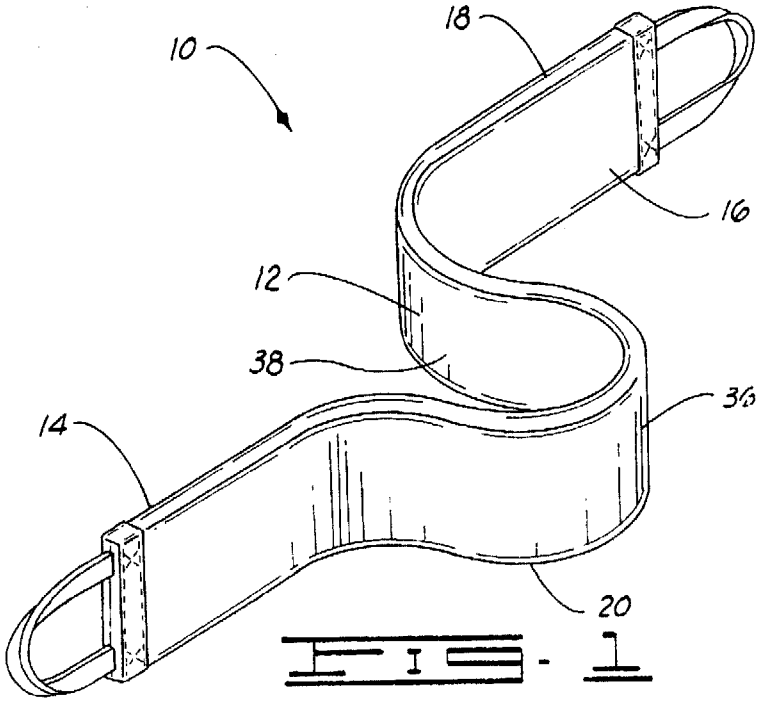
FIG. 1 is a perspective view of a lotion applicator constructed in accordance with the present invention.

Referring to the drawings in detail and to FIG. 1 in particular, reference character 10 generally designates a lotion applicator constructed in accordance with the present invention. The applicator 10 includes a body 12, a left end 14 and a right end 16.

For the purpose of this description, the words left, right, front, rear, top, bottom, inside and outside may be used to describe the various parts and directions of the invention as depicted in FIG. 1. These descriptive terms should not be considered as limiting the possible orientations of the invention or how it may be used. The terms are merely used to describe the various parts and directions so they may be readily understood and located in the drawings.

The applicator body 12 is preferably made from a single rectangular piece of material having two longitudinal edges and two ends. The material preferably has at least one side, the face, which is generally smooth and non-absorbent which will form the outside of the applicator 10. The side of the material which will form the inside of the applicator preferably is a soft support backing to add body, thickness and strength to the material. While the material is preferably not elastic, it should be soft and pliable and should not stick to the skin. Thus, rubber and neoprene materials are generally not suitable for use with this invention. Since the preferable material is generally smooth and non-absorbent, lotions and oils will not build up in cracks, crevices or patterns in the material, but will be deposited on the skin and allow the applicator to rub them in.

In addition, the material is preferably non-laminated, non-woven so it will not absorb lotions or oils, and light enough to maintain flexibility and to lie smoothly across an individual's body so it may be drawn across, down, and around one's body. The most preferred material is a polyvinylchloride (PVC) material with a leather look and textile softness and a non-woven polyester backing. One such material is Echo Texhide made by Intex Plastic Corp. This material is preferred over shiny finish material since it has been found that a shiny finish will dull and become sticky when lotions are used. A suitable weight of material is PVC or vinyl material having a weight of about twelve ounces per square yard. This material is sometimes described as having a kid leather feel. However, the material should not be a real leather since that type of material will absorb lotions and oils, making it hard to clean or sterilize, and will waste lotion.

While the most preferred material has a weight of about twelve ounces per square yard, it should be noted that material with a slightly greater or lesser weight will work, but a material having a weight of more than sixteen ounces per square yard or less than eight ounces per square yard is much less preferable. If the material is too weighty, it adversely affects the flexibility of the applicator and can make it less comfortable to use. If the material is too light, the applicator is likely to fold or otherwise fail to lie smoothly across the skin.

Laminated woven materials generally will not hold up as well. Washing often makes the material cloudy and will sometimes cause it to separate. Creams often cause dullness, and heat, repeated use and the like cause the outside surface to crack, become ridged or hard, and scratch the skin. It has also been found that laminated woven materials are generally too light and can cause the body 12 to fold in when in use. This reduces the surface area contacted and prevents the smooth application of a lotion, cream or oil. This type of folding also is less efficient in rubbing in the lotion, cream or oil and may allow for them to accumulate on the applicator instead of being deposited on the skin.

Figure 2:
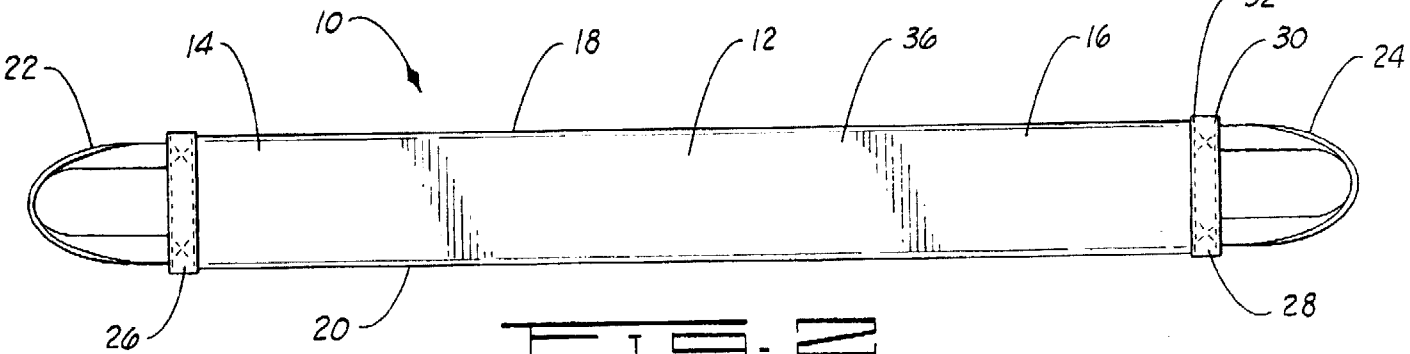
FIG. 2 is a top plan view of the applicator of FIG. 1.

The rectangular piece of material is then folded approximately in half by bringing the two longitudinal edges together and thereby forming an upper edge 18. The applicator 10 will have identical front and back sides 36 and 38 as viewed in FIG. 1, or top 36 and bottom as shown in FIG. 2. The joining of the two longitudinal edges thus forms a lower edge 20. The original fold should be made such that the inside, or backing of the material, is exposed. In this way, the two longitudinal edges may be connected such as by sewing. Then the body may be turned right side out to expose the generally smooth non-absorbent side of the material. Left and right handles 22 and 24 as well as left and right twill tape 26 and 28 are then attached to close the left and right ends 14 and 16 of the body 12.

One should pay particular attention when attaching the left and right handles 22 and 24 to ensure that the desired open loop is formed by the handles. This open loop shape is accomplished by attaching one end of a handle to the body 12 and then bringing the other end of the handle to the body so the same side of the handle material is up when it is attached to the body. If the opposite sides of the handle are up when attached to the body, the handle will fold and flatten, making it much more difficult for one to use the handles. This is particularly true when one is suffering under a disability. It should also be noted that in the preferred embodiment, the ends of the handles are attached to the backing side of the material so they will be inside the body when the applicator is fully assembled.

In addition, the handles should be non-abrasive. For example, each handle is preferably made from a single strip of soft flexible elastic material without any folds or seams. Thus, the handle is open and easy to grasp but will not unduly irritate sensitive skin.

Twill tape, such as left and right twill tapes 26 and 28, may then be connected to the body 12 to close the left and right ends 14 and 16 of the body 12, and further secure the handles. The twill tape is preferably sewn to the body with at least two rows of stitching as represented by numerals 30 and 32. The inside row of stitching 32 is preferably as close to the edge of the twill tape 28 as possible. In this way, the twill tape 28 is held to the body 12 and will not flair up or separate from the body. The stitching on the left twill tape 26 should be located similarly.

The left and right handles 22 and 24 are preferably made from soft cotton elastic to prevent the stiffness and roughness of a polyester elastic. In this way, a person with a burn, sensitive skin, sores, or any skin condition need not worry about the handle being abrasive to the back, neck, hands, arms, feet, or any other part of the body. In addition, it has been found that the use of a stiff material for the handles can cause the applicator 12 to flip over when in use.

The twill tapes 26 and 28 are preferably made from 100% cotton so it will also be soft to the touch. It should also be noted that sewn-on tags should not be used since they may provide edges which may irritate sensitive skin. If one desires to attach information, such as a trademark or the like, to the apparatus it is preferably screen printed on the twill tape. This way, the information is clearly visible but will not provide a rough or abrasive surface, and the device will be gentle and non-abrasive. This is of particular importance when the device is used by a person with a burn, sensitive skin, sores or other skin condition.

Figure 5:
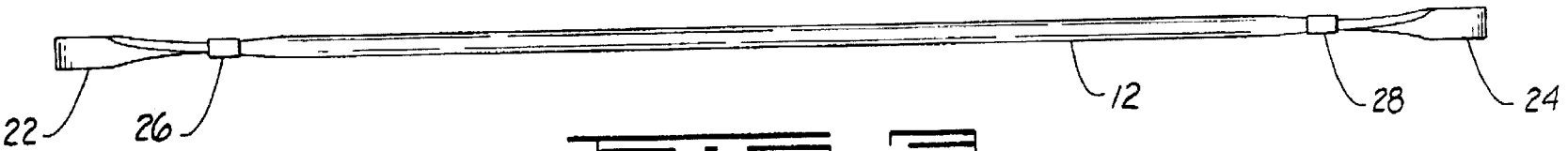
FIG. 5 is another top plan view of the applicator of FIG. 4 with portions of the applicator removed.
Figure 4:
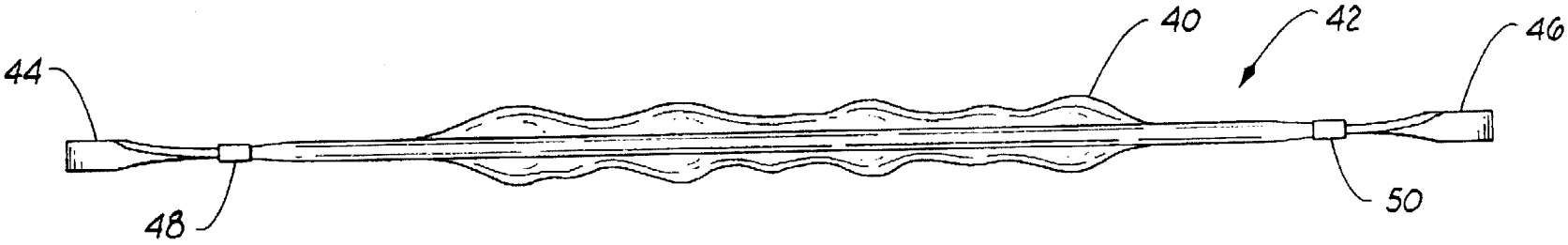
FIG. 4 is front elevational view of another embodiment of a lotion applicator constructed in accordance with the present invention.

Referring now to FIGS. 4 and 5, another preferred embodiment of the current invention is represented by numeral 42. In this embodiment, objects are contained in the body 40 of the applicator 42 to provide a massaging effect when used. In this embodiment, the body 40, the left and right handles 44 and 46, and the left and right twill tape 48 and 50 are all assembled the same as or similar to the prior embodiment. The same material descriptions and construction limitations apply to this embodiment as well. However, in this embodiment, a material sleeve 52 is included inside the body 40 of the applicator 42.

The sleeve 52 is essentially a tube of soft material and is attached to the applicator and sealed inside the body 40. In this way, lotion or the like cannot enter into the body and be absorbed by the tube. The tube may be attached at about the same location as the left and right twill tapes 48 and 50. Stitch lines across the tube divide the tube into a plurality of pockets. In FIGS. 4 and 5, stitch lines 54, 56, 58, 60 and 62 are shown dividing the sleeve 52 into pockets. Objects placed in the pockets provide a massage when the applicator 42 is used. Since the body 40 of the applicator 42 is generally smooth, this embodiment may be and is often used without lotions, creams or oils for the massaging effect alone. While FIGS. 4 and 5 each show four pockets with each pocket containing one object, it should be understood that fewer or more pockets, and even a greater number of objects per pocket may be used. Preferably no more than eight and no fewer than three pockets are provided and more preferably four to six pockets are provided. While different sizes and numbers of objects may be included in each pocket, it has been found that one or two relatively large objects provide the best results.

The objects in the pockets are preferably devoid of sharp edges and are preferably spherical or cylindrical in shape. By way of example and not limitation, some suitable objects are balls, corks and beads. Most preferably a single ball approximately the size of a golf ball is used. This size provides a good massaging action when four to six are spaced along the length of the applicator. While larger or smaller objects may be used, it has been found that placing a single object with a diameter of less than about ¾ inch in a pocket does not provide a suitable massaging effect. Likewise objects having a diameter of greater than about 2½ inches are too large and cause the body to bulge too much to perform well as a lotion applicator. One suitable object which may be placed in the pockets is a plastic golf wiffle ball such as ball 72 shown in FIG. 5. This type of ball is light weight, yet strong enough to withstand aggressive use when one is massaging muscles and will withstand the harsh environment of a clothing washer or dryer. It has also been found that the use of three to six large balls, such as the plastic golf balls, are preferred since they prevent the body from wrinkling and holding lotion as may happen with the use of a large number of smaller objects. In addition, this number of balls allow the pockets to be large enough to allow the balls to move somewhat within the pockets, thus providing a preferred massaging effect.

FIG. 6 shows yet another preferred embodiment. In this embodiment a lotion applicator 82 has a body 84 with left and right handles 86 and 88, similar to the previous embodiment. However, in this embodiment the balls 90, 92, 94, 96 and 98 are not in pockets, but are strung on a line 104 extending from the right end 100 to the left end 102 of the applicator 82.

The line may be of any type that will hold the balls and can be connected to the applicator, but preferably the line is non-rigid and has elastic properties. In this way the balls are allowed to move inside the applicator to provide an enhanced massaging effect. One suitable material for the line 104 is an elastic strip or band.

It is also desirable for the balls 90–98 to be able to slide along the line 104, but left and right stops 106 and 108 are preferably secured to the line 104 to prevent the balls from reaching the left or right ends of the applicator. The left and right stops may be any article or even a knot tied in the line, but preferably the stops are made from relatively small beads secured to the line such as by tying.

The massaging effect of the applicator 82 may be enhanced if the balls are space apart slightly. This may be accomplished by placing spacers between each of the balls. Spacers 110, 112, 114 and 116 shown in FIG. 6 provide sufficient spacing between the balls. While any type of spacer, such as a tube or even multiple stops like stops 106 and 108 may be used, the preferred spacers are balls which are smaller than the balls 90–98. The use of smaller balls provide the preferred spacing. While the balls 90–98 may be made of any durable material, wooden beads have been found to be particularly well suited.

Figure 3:
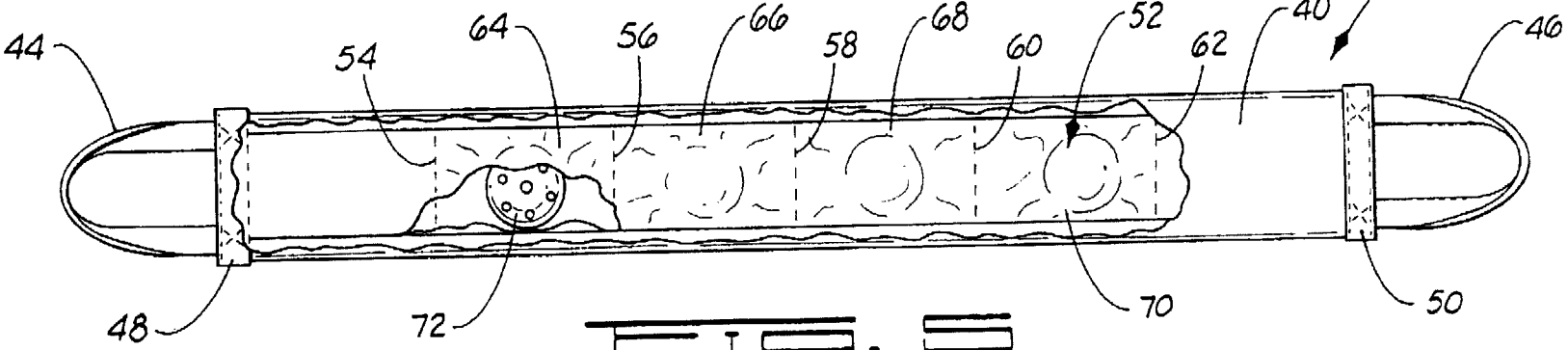
FIG. 3 is a front elevational view of the applicator of FIG. 1.
Figure 3:
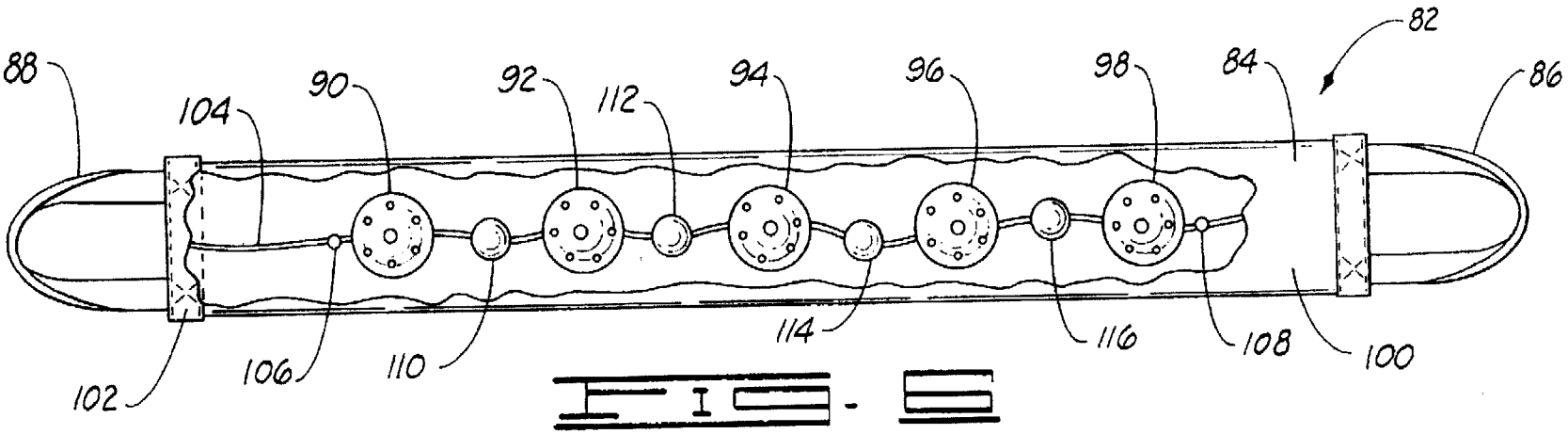

In operation, the embodiment of FIGS. 1–3 may be used to apply creams, lotions, oils, medicines, unguents, salves, ointments, balms, cold creams, emollients, liniments, moisturizers, liquids, solutions, gels, or pastes to various parts of one's body. By way of example, and not limitation, some common materials which may be applied with the applicator 10 are: suntan oil, cream or gel, sun screen, body lotion, moisturizing lotions and creams, lanolin, antiseptic lotions, creams or gels, hand creams and baby oil.

The desired material to be applied is deposited on one side of the applicator 10. While either side of the applicator may be used, preferably one side is used at a time. The applicator is then rubbed across the area of the body where the material is to be deposited and worked in. Since the handles have an open loop shape and are made from an elastic material, the applicator may be held in many different ways. For example, the individual may use a hand to grasp the handles, or hook a finger, thumb, wrist, forearm or stub through each handle.

The embodiments of FIGS. 3–6 may be similarly used for applying material and may also be used to massage portions of an individual's body. Since the handles are elastic, a generally constant smooth pressure may be exerted by the objects or balls in the applicator 42. This type of massage is particularly helpful when applied to the neck, shoulders, lower back, leg, or foot. In the case of a diabetic, the massaging action of the applicator 42 may help increase circulation in the foot or toes. For a person who has lost the function of one or more legs, the massage is very helpful for the affected limb. Large individuals or those with arthritis may use the applicator to aid in reaching the feet or back.

Changes may be made in the combinations, operations and arrangements of the various parts and elements described herein without departing from the spirit and scope of the invention, as defined in the following claims.

I claim:

1. A lotion applicator comprising:

a flexible body having a left end, a right end, a top and a bottom, and wherein both the top and the bottom each have a generally smooth, non-absorbent exterior surface made from a non-woven material;

an elongated strip of elastic material having two ends, both ends being attached to the left end of the flexible body to form an open loop left handle; and an elongated strip of elastic material having two ends, both ends being attached to the right end of the flexible body to form an open loop right handle.

2. The lotion applicator of claim 1 wherein the flexible body is made from a vinyl material.

3. The lotion applicator of claim 2 wherein the vinyl material has a material weight of about twelve ounces per square yard.

4. The lotion applicator of claim 2 wherein the vinyl material has a material weight of not less than eight ounces per square yard and not more than sixteen ounces per square yard.

5. The lotion applicator of claim 4 further comprising a left twill tape and a right twill tape, the left twill tape being stitched to the left end of the flexible body to connect the top and the bottom of the flexible body together and to connect the left handle to the flexible body; the right twill tape being stitched to the right end of the flexible body to connect the top and the bottom of the flexible body together and to connect the right handle to the flexible body.

6. The lotion applicator of claim 4 wherein left and right handles are made from a cotton elastic.

7. The lotion applicator of claim 6 wherein the flexible body is made from a single piece of rectangular material folded, having longitudinal sides wherein the material is folded generally in half, and the longitudinal sides are connected.

8. The lotion applicator of claim 7 wherein the rectangular material is not a laminated material.

9. The lotion applicator of claim 1 wherein the flexible body is made from a material having a polyvinylchloride outside surface with a leather look and textile softness, and wherein the material has a non-woven backing.

10. A lotion applicator and massaging device comprising:

a flexible body having a left end, a right end, a top and a bottom, and wherein both the top and the bottom each have a generally smooth non-absorbent exterior surface;

an elongated strip of elastic material having two ends, both ends being attached to the left end of the flexible body to form an open loop left handle;

an elongated strip of elastic material having two ends, both ends being attached to the right end of the flexible body to form an open loop right handle; and a two ended material tube sealed inside the flexible body, the tube being divided into a plurality of pockets and wherein one end of the tube is connected to the left end of the flexible body and one end of the tube is connected to the right end of the flexible body, and wherein each pocket contains at least one object to provide a massaging effect when the device is in use.

11. The lotion applicator and massaging device of claim 10 wherein the tube has at least three but not more than five pockets.

12. The lotion applicator and massaging device of claim 10 wherein each object is a plastic ball.

13. The lotion applicator and massaging device of claim 12 wherein each ball has a diameter of greater than ¾ inch and a diameter of less than 2½ inches.

14. The lotion applicator and massaging device of claim 13 wherein each ball is generally the size of a golf ball.

15. The lotion applicator and massaging device of claim 14 wherein each tube contains a single ball.

16. The lotion applicator of claim 10 wherein the flexible body is made from a vinyl material with a material weight of not less than eight ounces per square yard and not more than sixteen ounces per square yard.

17. The lotion applicator of claim 16 further comprising a left twill tape and a right twill tape, the left twill tape being stitched to the left end of the flexible body to connect the top and the bottom of the flexible body together and to connect the left handle to the flexible body; the right twill tape being stitched to the right end of the flexible body to connect the top and the bottom of the flexible body together and to connect the right handle to the flexible body.

18. The lotion applicator of claim 17 wherein left and right handles are made from a cotton elastic.

19. The lotion applicator of claim 18 wherein the flexible body is made from a single piece of rectangular material folded, having longitudinal sides wherein the material is folded generally in half and the longitudinal sides are connected.

20. A lotion applicator and massaging device comprising:

a flexible body having a left end, a right end, a top and a bottom, and wherein both the top and the bottom each have a generally smooth, non-absorbent exterior surface;

an elongated strip of elastic material having two ends, both ends being attached to the left end of the flexible body to form an open loop left handle;

an elongated strip of elastic material having two ends, both ends attached to the right end of the flexible body to form an open loop right handle;

a line inside the flexible body and extending from generally the left end to the right end;

a plurality of balls connected to the line to provide a massaging effect when the lotion applicator is in use; and a plurality of spacers connected to the line and positioned between the balls to provide spacing between the balls.

* * * * *